US009062848B2

(12) United States Patent
Sato et al.

(10) Patent No.: US 9,062,848 B2
(45) Date of Patent: Jun. 23, 2015

(54) LIGHT SOURCE DEVICE AND ILLUMINATION DEVICE INCLUDING THE LIGHT SOURCE DEVICE

(75) Inventors: Eiichi Sato, Hachioji (JP); Ken Sato, Hachioji (JP); Hiroyasu Sato, Hachioji (JP)

(73) Assignee: OPTO DESIGN, INC., Tokyo (JP)

( * ) Notice: Subject to any disclaimer, the term of this patent is extended or adjusted under 35 U.S.C. 154(b) by 63 days.

(21) Appl. No.: 14/116,672

(22) PCT Filed: Jun. 8, 2012

(86) PCT No.: PCT/JP2012/064821

§ 371 (c)(1),
(2), (4) Date: Nov. 8, 2013

(87) PCT Pub. No.: WO2012/169624

PCT Pub. Date: Dec. 13, 2012

(65) Prior Publication Data

US 2014/0119028 A1 May 1, 2014

(30) Foreign Application Priority Data

Jun. 9, 2011 (JP) ..... 2011-129200

(51) Int. Cl.
*F21V 7/00* (2006.01)
*F21V 13/10* (2006.01)

(52) U.S. Cl.
CPC ..... *F21V 7/0025* (2013.01); *F21V 7/0041* (2013.01); *F21V 13/10* (2013.01)

(58) Field of Classification Search
CPC ..... F21K 9/54; F21V 7/0025; F21V 7/0033; F21V 7/0041; F21V 7/22; F21V 11/14; F21V 13/10; F21Y 2101/02
See application file for complete search history.

(56) References Cited

U.S. PATENT DOCUMENTS

2010/0061096 A1* 3/2010 Sato ..... 362/235
2011/0018012 A1* 1/2011 Tanaka et al. ..... 257/89

FOREIGN PATENT DOCUMENTS

JP 08-153405 A 6/1996
JP 2003-123526 A 4/2003

(Continued)

OTHER PUBLICATIONS

International Search Report dated Sep. 11, 2012, issued in corresponding application No. PCT/JP2012/064821.

(Continued)

*Primary Examiner* — Stephen F Husar
(74) *Attorney, Agent, or Firm* — Westerman, Hattori, Daniels & Adrian, LLP

(57) ABSTRACT

An illumination device including a light source device includes a light source being constituted by LED(s); a light source side reflective plate to which the light source is fixed; an emission side reflective plate facing the light source side reflective plate; and a fixing means for fixing the both reflective plates, wherein the emission side reflective plate is formed so that a portion thereof facing the light source has the highest optical reflectance and the lowest optical transmittance while the optical reflectance decreases and the optical transmittance increases farther away from the light source, and the distance between the both reflective plates is greatest at a portion where the light source is disposed, while the distance decreases at portions farther away from the portion where the light source is disposed. Thus the device can supply light in a substantially uniform manner from a light irradiation surface.

7 Claims, 13 Drawing Sheets

(56) References Cited

FOREIGN PATENT DOCUMENTS

| | | | |
|---|---|---|---|
| JP | 2003-330394 | A | 11/2003 |
| JP | 2006-012818 | A | 1/2006 |
| JP | 2009-004248 | A | 1/2009 |
| JP | 2009-016093 | A | 1/2009 |
| WO | 2011/033900 | A1 | 3/2011 |

OTHER PUBLICATIONS

Notification of Transmittal of Translation of the International Preliminary Report on Patentability dated Dec. 27, 2013 (form PCT/IB/338) of International Application No. PCT/JP2012/064821, with forms PCT/ISA/237 (with English translation), PCT/IB/326 and PCT/IB/373 (11 pages).

* cited by examiner

LIGHT SOURCE DEVICE AND ILLUMINATION DEVICE INCLUDING THE LIGHT SOURCE DEVICE

TECHNICAL FIELD

The present invention relates to an illumination device, and more particularly to an illumination device that is thin and can illuminate a light irradiation surface in a substantially uniform manner using a light-emitting diode as a light source.

BACKGROUND ART

Over recent years, research and development of light-emitting diodes (hereinafter referred as to "LEDs") have been advancing at a rapid pace, with various types of LEDs being developed, productized, and used in a wide range of fields. Due to their features of low power consumption, long life, and compactness, LEDs have long been much used as operation indicator lights for electronic equipment and the like. These LEDs have been used in, for example, backlights for liquid crystal panels, various kinds of display boards, electronic signboards, decorative illumination devices and so forth, and have now come to be used in the field of illumination. In the illumination field, they are used for automobile headlights and taillights, in light-bulb illumination devices and planar illumination devices incorporating a plurality of LEDs, in illumination devices that incorporate LEDs inside a tube and can be used in the same manner as fluorescent tubes, for example.

The planar light sources that are used for indoor illumination devices and the like are required to emit light uniformly, but since LEDs have strong light directionality, they are not suitable, without modification, to be used for indoor illumination devices. Thus, as light source devices using a related-art LED that are for obtaining illuminating light with planar, uniform illuminance distribution, light source devices in which reflection means is provided on the emitting surface of light so that the light is multiply reflected are well known (see Patent Documents 1 and 2 below). The strong-directionality light of LEDs causes unpleasant brightness called "glare" when it enters eyes directly. Light source devices that, in order to prevent this glare, are designed so that the light emitted from the light source is reflected once or more times at the sidewall of the aperture of reflection means provided inside the light source device or on its reflection surface to pass through the aperture are well known (see Patent Document 1 below).

In the light source device set forth in Patent Document 3, a point light source is provided in the bottom of a containing assembly called a casing or housing, and reflection means is provided at the mouth portion of the casing, or more precisely on the surface that faces the point light source, so that the strong-directionality light from the point light source is multiply reflected and uniformized to be emitted.

RELATED ART DOCUMENT

Patent Document

[Patent Document 1] JP-A-2006-012818

[Patent Document 2] JP-A-2009-016093

[Patent Document 3] JP-A-2009-004248 (paragraphs 0023, 0028 to 0039, FIG. 1A)

DISCLOSURE OF INVENTION

Problem to be Solved by the Invention

LEDs are smaller than the fluorescent lamps, for example, that have been used as a light source, so that illumination devices are becoming smaller and, in particular, thinner The light source device disclosed in each of Patent Documents 1 to 3 described above includes a box-shaped casing having a bottom portion and a sidewall portion, and has an overall box shape. Such a structure is suitable for the use of a plurality of devices connected as a unit. However, when being used separately, the light source device is limited in how thin it can become because of the sidewall portion having a particular height.

The light source device disclosed in each of Patent Documents 1 to 3 described above spreads the light from the point source in a planar manner and uniformizes the light emitted from a light irradiation surface through multiple reflection on the reflective plate disposed in the light emission direction of the LED, the bottom portion to which the LED is fixed, and the sidewall portion. However, thinning the illumination device reduces a distance between the LED of the light source device and the reflection means. In addition, depending on the material of the reflection means, the reflection means located directly above the LED absorbs more a particular wavelength of the light from the LED, thereby causing uneven colors to occur in the surrounding part. This poses a limitation in reducing the distance between the LED and the reflection means.

Thus, the present invention provides an illumination device that can be thinner while illuminating a light irradiation surface in a substantially uniform manner using a light-emitting diode as a light source.

Means for Solving Problem

A light source device of a first aspect of the present invention includes a light source, a light source side reflective plate to which the light source is fixed, an emission side reflective plate facing the light source side reflective plate, and fixing means for fixing the light source side reflective plate and the emission side reflective plate. In the illumination device, the light source is constituted by one or a plurality of light-emitting diodes; the emission side reflective plate is formed so that a portion thereof facing the light source has the highest optical reflectance and the lowest optical transmittance while the optical reflectance decreases and the optical transmittance increases as being farther away from the light source; and the distance between the light source side reflective plate and the emission side reflective plate is greatest at a portion where the light source is disposed and decreases as being farther away from the portion where the light source is disposed.

With the light source device of the first aspect of the present invention, the emission side reflective plate is formed so that the portion thereof facing the light source has the highest optical reflectance and the lowest optical transmittance while the optical reflectance decreases and the optical transmittance increases as being farther away from the light source. Therefore, uniform illumination light can be obtained from the whole surface of the emission side reflective plate although an LED is used as the light source. The distance between the light source side reflective plate and the emission side reflective plate is greatest at the portion where the light source is disposed. Thus, uneven colors are less likely to occur. At the same time, the distance between the light source side reflective plate and the emission side reflective plate decreases as being farther away from the portion where the light source is disposed, and is smallest at a circumferential edge portion of the illumination device. This can give visually thinner impression.

According to a second aspect of the present invention, in the light source device of the first aspect, the fixing means is a columnar body that is provided at outer edge portions of the light source side reflective plate and the emission side reflective plate and has a particular height; and the fixing means fixes the light source side reflective plate and the emission side reflective plate with a gap therebetween.

With the light source device of the second aspect of the present invention, light emitted from the light source is also output through the gap provided between the light source side reflective plate and the emission side reflective plate at the outer edge portion of the light source device. This prevents the outer edge portion from being dark, and provides more uniform illumination light.

According to a third aspect of the present invention, in the light source device of the first aspect, the fixing means is a member that fixes the light source side reflective plate and the emission side reflective plate without a gap therebetween at the outer edge portions of the light source side reflective plate and the emission side reflective plate.

With the light source device of the third aspect of the present invention, the light source side reflective plate and the emission side reflective plate are fixed without a gap therebetween. This can provide the light source device that gives a thinner impression at the outer edge portion thereof.

According to another aspect of the present invention, in the light source device of the first aspect, it is preferable that an optical diffusion plate be provided on the light emitting surface side of the emission side reflective plate with a particular gap from the emission side reflective plate.

The light source device of the present invention can achieve the particular functions and effects described above even with the emission side reflective plate exposed. However, using the diffusion plate having a light scattering effect can provide the illumination light having a more uniform illuminance distribution.

According to still another aspect of the present invention, in the illumination light source device of the first aspect, it is preferable that the light source include the light-emitting diodes arranged in a strip-like or ring-like manner.

An illumination device of one aspect of the present invention includes the above-mentioned light source device; and a diffusion plate covering the light source device.

According to another aspect of the present invention, in the illumination device of the another aspect, it is preferable that the illumination device further include a frame body to which the light source device is fixed.

The LED is a known point source of light having strong directionality and a large luminescence intensity. However, with the light source device and the illumination device of the present invention, using the light source including the light-emitting diodes arranged in a strip-like or ring-like manner can provide an illumination device that is brighter while having a large size.

BRIEF DESCRIPTION OF DRAWINGS

[FIG. 1]

FIG. 2 is an exploded perspective view of the illumination device of FIG. 1A.

FIG. 3 is a plan view of an emission side reflective plate of the illumination device of FIG. 1A.

FIG. 4 is a development view of the emission side reflective plate of FIG. 3.

[FIG. 5]

FIG. 6 is an exploded perspective view of the illumination device of FIG. 5A.

FIG. 7 is a perspective view of a light source device according to a third embodiment of the present invention.

FIG. 8 is an exploded perspective view of the light source device of FIG. 7.

FIG. 9 is a plan view of an emission side reflective plate of the light source device of FIG. 8.

FIG. 10 is an exploded perspective view of a modification of the light source device according to the third embodiment of the present invention.

FIG. 11 is a plan view of an emission side reflective plate of the light source device of FIG. 10.

FIG. 12 is an exploded perspective view of another modification of the light source device according to the third embodiment of the present invention.

FIG. 13 is a plan view of an emission side reflective plate of the light source device of FIG. 12.

BEST MODES FOR CARRYING OUT THE INVENTION

Embodiments of the present invention will now be described with reference to the accompanying drawings. The embodiments shown below are intended as examples of light source devices, illumination devices, and display devices in order to carry out the technical concepts of the invention, and not as limiting the present invention to these light source devices, illumination devices, and display devices. They can be equally applied to other embodiments falling within the scope and spirit of the appended claims.

[First Embodiment]

Figure 1A:
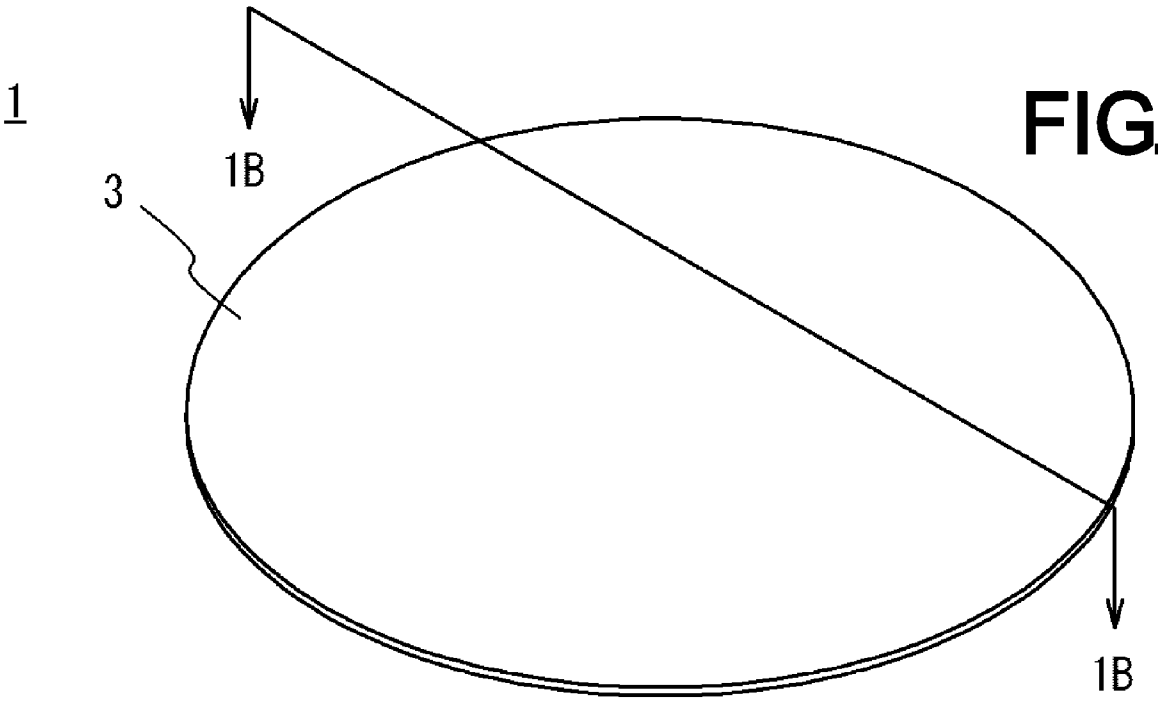
FIG. 1A is a perspective view of an illumination device according to a first embodiment of the present invention.
Figure 1B:
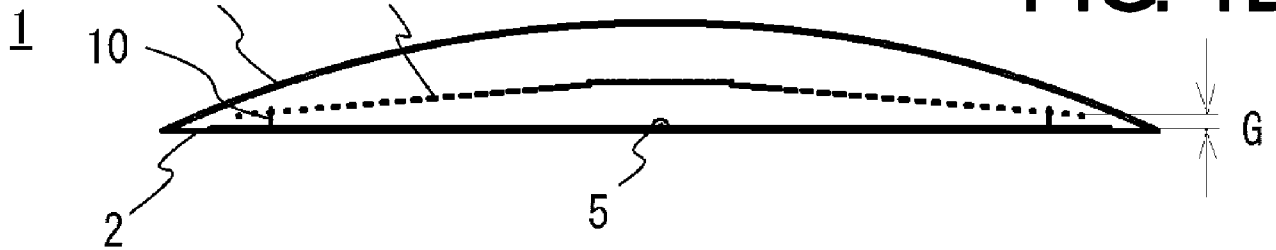
FIG. 1B is a sectional view along IB-IB line of FIG. 1A.
Figure 2:
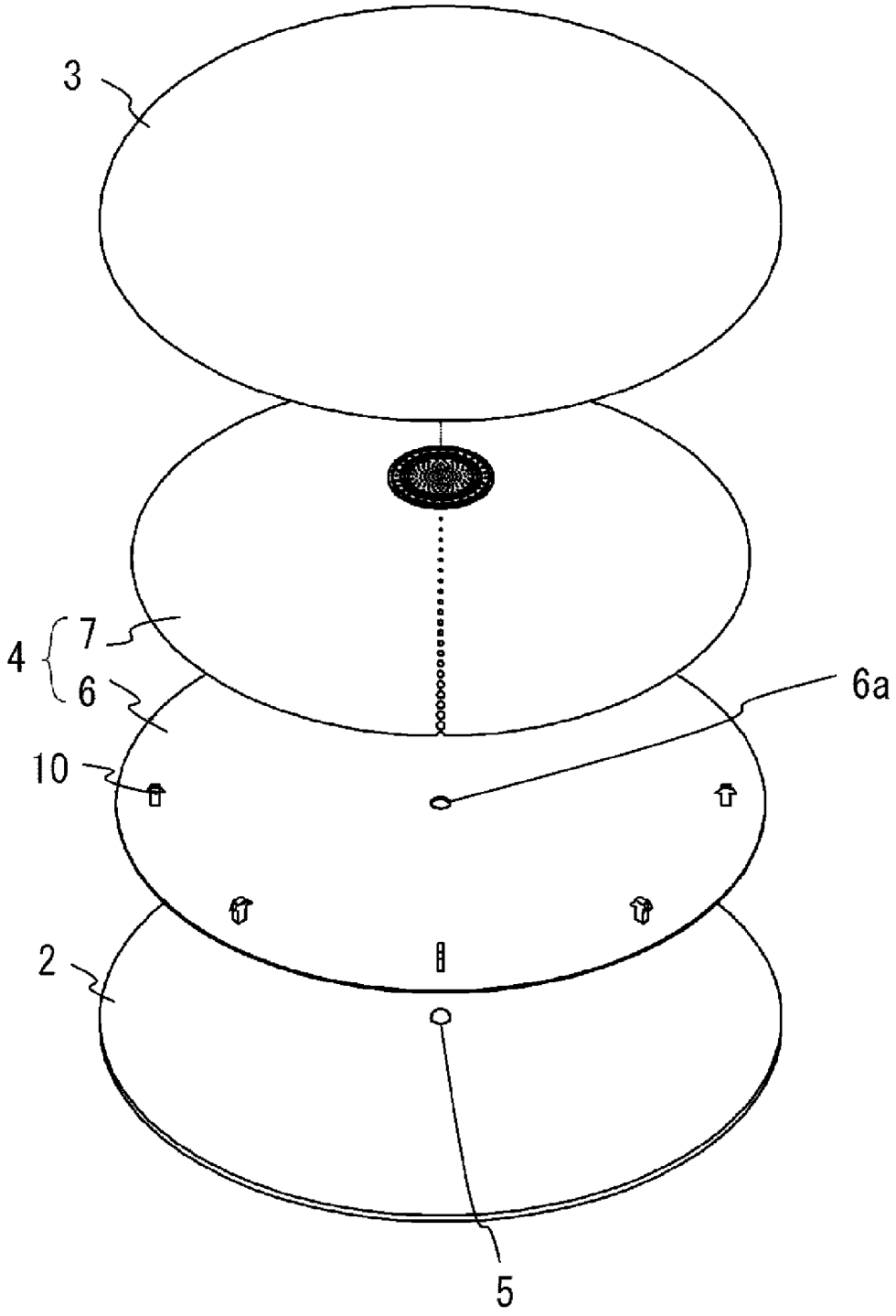
[FIG. 2]
Figure 3:
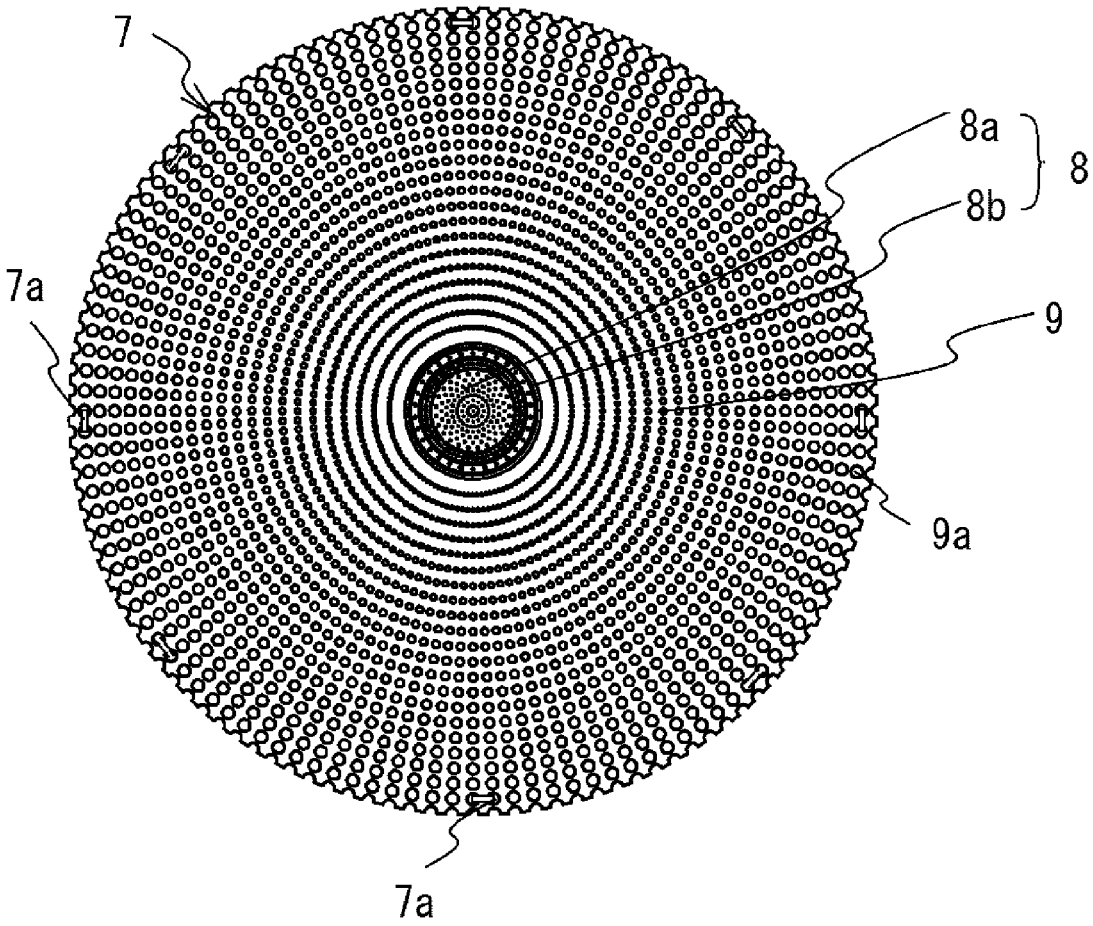
[FIG. 3]
Figure 4:
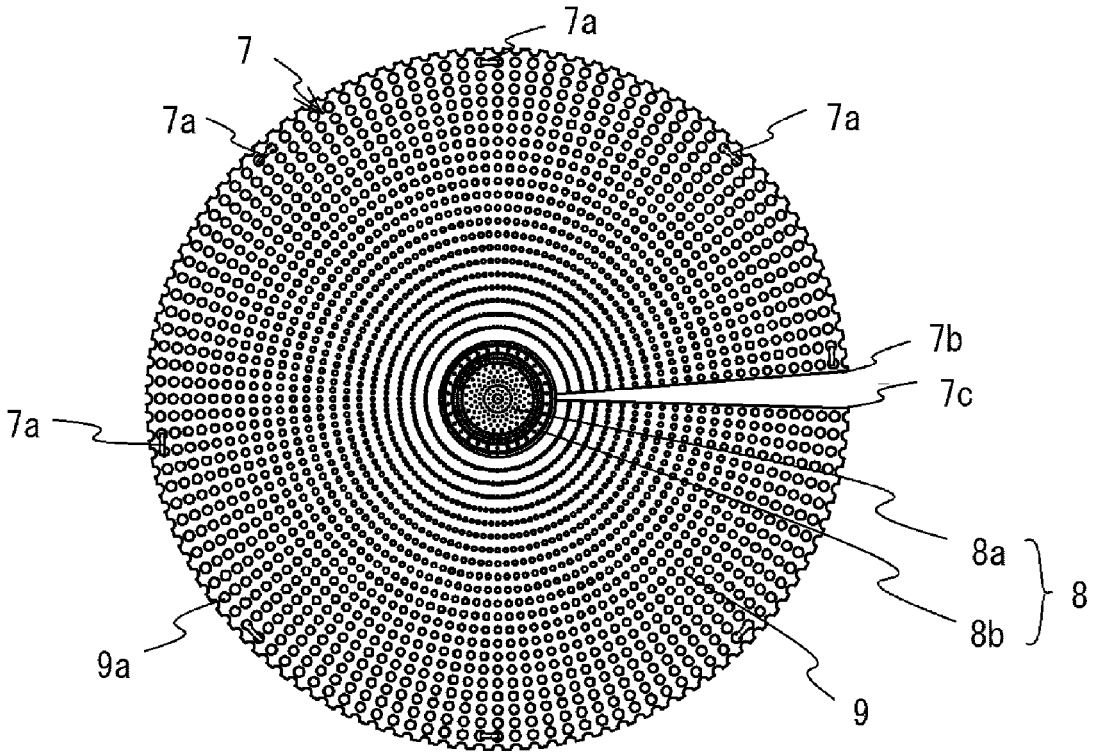
[FIG. 4]

An illumination device according to a first embodiment of the present invention will be described using FIGS. 1A to 4. FIG. 1A is a perspective view of the illumination device according to the first embodiment of the present invention; FIG. 1B is a sectional view along 1B-1B line of FIG. 1A; FIG. 2 is an exploded perspective view of the illumination device of FIG. 1A; FIG. 3 is a plan view of an emission side reflective plate of the illumination device of FIG. 1A; and FIG. 4 is a development view of the emission side reflective plate of FIG. 3.

As illustrated in FIGS. 1A, 1B, and 2, this illumination device 1 according to the first embodiment includes a flat plate-like frame body 2, a light source device 4 fixed to the frame body 2, and a dome-like diffusion plate 3 that is mounted so as to cover the frame body 2 and the light source device 4.

The frame body 2 is formed of metal plate material or a synthetic resin formed body, and has a disk-like shape in the first embodiment. The light source device 4 and a substrate (not illustrated) connected to a light source 5 disposed in the light source device 4 are disposed on the frame body 2. The light source device 4 is covered by the diffusion plate 3 with a particular gap therebetween. Although using solely the light source device 4 can provide uniform illumination light, using the diffusion plate having a light scattering effect can protect the light source device 4 from external impacts and can provide the illumination light having a more uniform illuminance distribution.

As illustrated in FIGS. 1A to 3, the light source device 4 includes the light source 5 including an LED, a flat plate-like light source side reflective plate 6 to whose central portion the light source 5 is fixed, and an emission side reflective plate 7 that is disposed so as to face the light source side reflective plate 6. The light source 5 is fixed to the substrate (not illustrated) fixed to the frame body 2, and further connected to an external power supply or other units. In the first embodiment, the light source 5 is an LED having one light-emitting element or a plurality of light-emitting elements, and serves as a point source of light.

A mounting hole 6*a* for installing the light source 5 is provided at the center of the light source side reflective plate 6. The light source side reflective plate 6 may serve as a ceiling surface or as a sidewall surface depending on the installation condition of the light source device 4. A surface of the light source side reflective plate 6 on which the light source 5 is disposed is formed of a material, such as an ultra-fine foamed light reflecting member, having a high optical reflectance, and reflects light emitted from the light source 5 and reflected by the emission side reflective plate 7 at a high optical reflectance through multiple reflection, thereby enabling the efficient use of light.

Fixing members 10 for fixing the emission side reflective plate 7 are provided at particular intervals near a circumferential edge portion of the light source side reflective plate 6. The fixing members 10 each have a plate-like body mounted perpendicular to the light source side reflective plate 6, and the top of the plate-like body forms a locking claw for locking the emission side reflective plate. Locking the locking claw into a locking hole 7*a* provided in the emission side reflective plate 7 can fix the emission side reflective plate 7 to the light source side reflective plate 6.

In the first embodiment, the emission side reflective plate 7 has a cone shape with its top cut off in a plane parallel to its base, that is, a truncated cone shape, and the base thereof is open (refer to FIG. 1B). Specifically, the distance between the light source side reflective plate 6 and the emission side reflective plate 7 is greatest at the portion where the light source 5 is disposed, and decreases as being farther away from the light source 5 to be smallest at the circumferential edge portion of the illumination device 1. A gap G is provided between ends of the light source side reflective plate 6 and the emission side reflective plate 7. In the first embodiment, the distance between the light source 5 and the emission side reflective plate 7 is 5 mm for example, and the distance between the ends of the light source side reflective plate 6 and the emission side reflective plate 7, that is, G is 2 mm for example.

A part of a disk-like ultra-fine foamed light reflecting member is cut off to form a sector shape as illustrated in FIG. 4, and sides 7*b* and 7*c* of the cut-off portion are joined together and fixed with adhesive or the like. Thus, the emission side reflective plate 7 of the first embodiment is formed into the truncated cone shape. The shape of the emission side reflective plate 7 is not limited to the truncated cone shape as long as it is a shape with which the distance between the light source side reflective plate 6 and the emission side reflective plate 7 is greatest at the portion where the light source is disposed, and decreases as being farther away from the light source 5. The shape may be a truncated pyramid shape whose base has a polygonal shape, and a part of a sphere, for example. While different shapes of the emission side reflective plate 7 give different degrees of multiple reflection between the emission side reflective plate 7 and the light source side reflective plate 6, adjustment of the optical reflectance and optical transmittance of the emission side reflective plate 7 as described below allows the emission side reflective plate 7 to emit the uniform illumination light from the whole surface thereof.

The emission side reflective plate 7 is formed of a material, such as the ultra-fine foamed light reflecting member, that has a high optical reflectance and a low optical transmittance. This allows the light from the light source 5 to be efficiently used through reflection to the light source side reflective plate 6 at a high optical reflectance, and allows a certain amount of light to pass at a portion directly above the light source 5, so that the portion directly above the LED is not too dark. A lighter weight of the ultra-fine foamed light reflecting member can prevent the weight of the illumination device 1 from being increased when the size thereof is increased. The easy availability and relatively low cost of the ultra-fine foamed light reflecting member can prevent a cost from being increased in the case of producing the illumination device 1 having a large size.

As illustrated in FIG. 3, the emission side reflective plate 7 is provided with a central light conducting reflection section 8 at a portion directly above the light source 5, and an outer light conducting reflection section 9 around the outer circumference of the central light conducting reflection section 8. The central light conducting reflection section 8 corresponds to the top portion of the emission side reflective plate 7 having the truncated cone shape. A central portion 8*a* is provided in the central part of the central light conducting reflection plate section 8, that is, at the portion directly above the light source 5. The central portion 8*a* is formed to have high optical reflectance and low optical transmittance, and reflects the intense light emitted from the light source 5; this reflected light is further reflected by the light source side reflective plate 6; and a part of the reflected light is multiply reflected by the emission side reflective section 7.

The optical reflectance of the central portion 8*a* is determined as appropriate depending on selection of material of light reflection plate and processing (for example, formation of half-slits and adjustment of the sheet thickness) of such material, thereby the light can be utilized with good efficiency. A peripheral portion 8*b* is provided on the periphery of the central portion 8*a*, that is, at the boundary with the outer light conducting reflection plate section 9. The peripheral portion 8*b* has a small hole and is designed to have the second highest optical reflectance behind the central portion 8*a*, but on the other hand to allow part of the light to pass through. A slit and a fine groove may be provided instead of the small hole.

In the outer light conducting reflection plate section 9, round conducting holes 9*a* are formed at particular intervals. The size of the conducting hole 9*a* increases steadily with a larger distance outward from the central light conducting reflection section 8. In other words, the outer light conducting reflection section 9 is formed so as to have a lower optical reflectance and a higher optical transmittance as being farther away from the light source 5. The conducting holes 9*a* can have various shapes including polygons, such as rectangles and triangles, and star shapes. Instead of the conducting holes 9*a*, slits having concentric ring shapes or square shapes may be provided, with the width and the length thereof increasing farther away outward from the central light conducting reflection section 8.

As described above, the light emitted from the light source 5 is multiply reflected between the light source side reflective plate 6 and the emission side reflective plate 7, and partially passes through the emission side reflective plate 7, so that the uniform illumination light can be obtained from the whole surface of the emission side reflective plate 7. However, when the light source device 4 is thinned to an extent that the distance between the light source 5 including the LED and the emission side reflective plate is reduced to less than 3 mm for example, the portion of the emission side reflective plate 7 facing the light source 5 is irradiated by intenser light. In this case, depending on the material of the emission side reflective plate, the reflection means located directly above the light source 5 absorbs more a particular wavelength of the light from the light source 5, thereby causing uneven colors to occur in the surrounding part.

To prevent the uneven colors, in the present invention, the distance between the light source side reflective plate 6 and the emission side reflective plate 7 is set so as to be greatest at the portion where the light source 5 is disposed. At the same time, the distance between the light source side reflective plate 6 and the emission side reflective plate 7 decreases as being farther away from the portion where the light source 5 is disposed and is smallest at the circumferential edge portion of the illumination device 1. This can give a visually thinner impression. In addition, the light emitted from the light source is also output through the gap provided between the light source side reflective plate 6 and the emission side reflective plate 7. This prevents the outer edge portion from being dark, thereby providing more uniform illumination light.

In the first embodiment, the light source side reflective plate 6 and the frame body 2 each have a flat plate-like shape, so that the illumination device 1 is easily mounted onto a flat surface such as a wall surface. However, depending on the place where the illumination device 1 is disposed, not only the emission side reflective plate 7 but also the light source side reflective plate 6 can have a shape such as a truncated cone shape, a truncated pyramid, or a part of a sphere as long as the distance between the light source side reflective plate 6 and the emission side reflective plate 7 is configured to be greatest at the portion where the light source is disposed, and to decrease as being farther away therefrom.

The emission side reflective plate 7 may be formed by sticking a film provided with a reflective section to a light conductive member such as a transparent plate using vapor deposition, printing, or the like. In this case, the optical reflectance and the optical transmittance are set to appropriate values by providing reflective dots, instead of the conducting holes or the slits, on the peripheral portion of the central light conducting reflection plate and on the outer light conducting reflection plate. The pattern of the reflective dots can be the same as the pattern of the conducting holes, or otherwise any desired pattern. The reflective dots can have a circular, a square, or any other shape in the same manner as the conducting holes.

Using printing or vapor deposition to form the emission side reflective plate and the light source side reflective plate makes it possible to produce the reflective plates using existing equipment, and makes it easy to produce not only the emission side reflective plate or other members having a flat plate-like shape but also the emission side reflective plate or other members having a curved surface. Specifically, it is possible to easily produce an emission side reflective plate or other members having a truncated cone shape, as the emission side reflective plate of the first embodiment, or having a shape like a part of a sphere. Furthermore, easy mass production of the emission side reflective plate or other members can save on expenses in producing a large quantity of the emission side reflective plates and the light source side reflective plates.

[Second Embodiment]

Figure 5A:
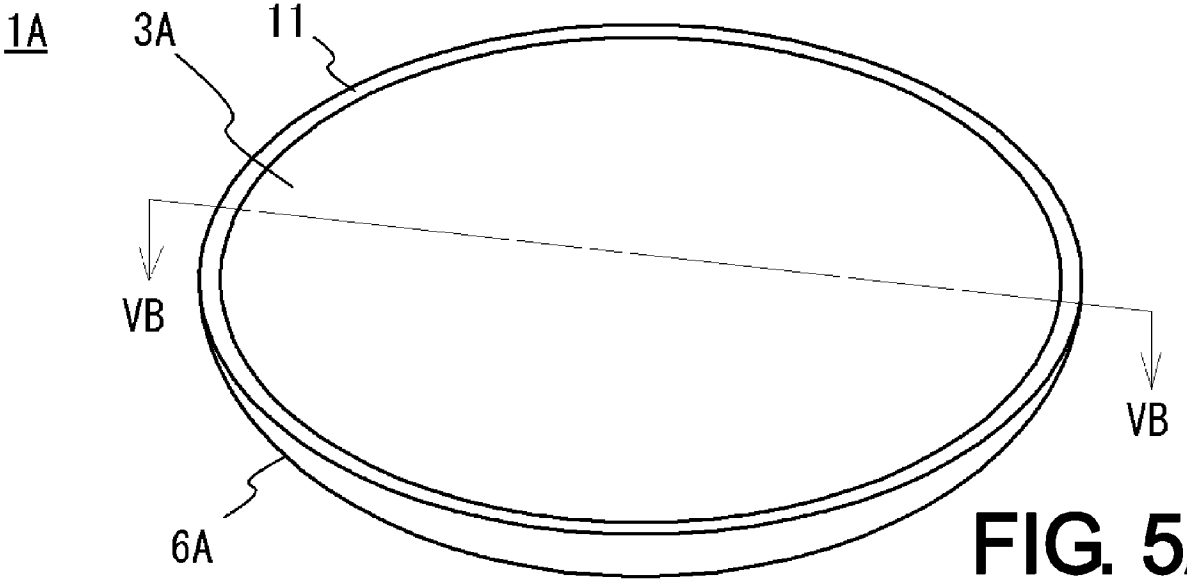
FIG. 5A is a perspective view of an illumination device according to a second embodiment of the present invention.
Figure 5B:
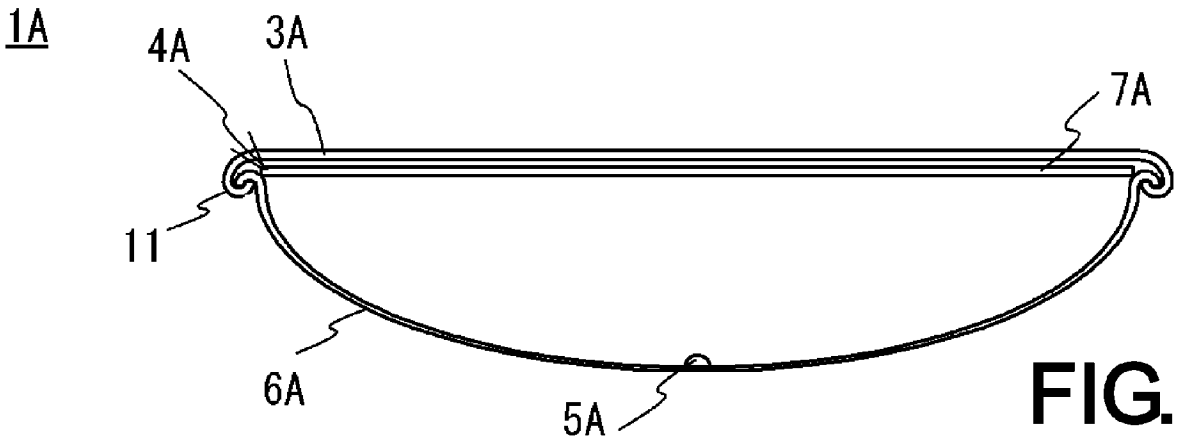
FIG. 5B is a sectional view along VB-VB line of FIG. 5A.
Figure 6:
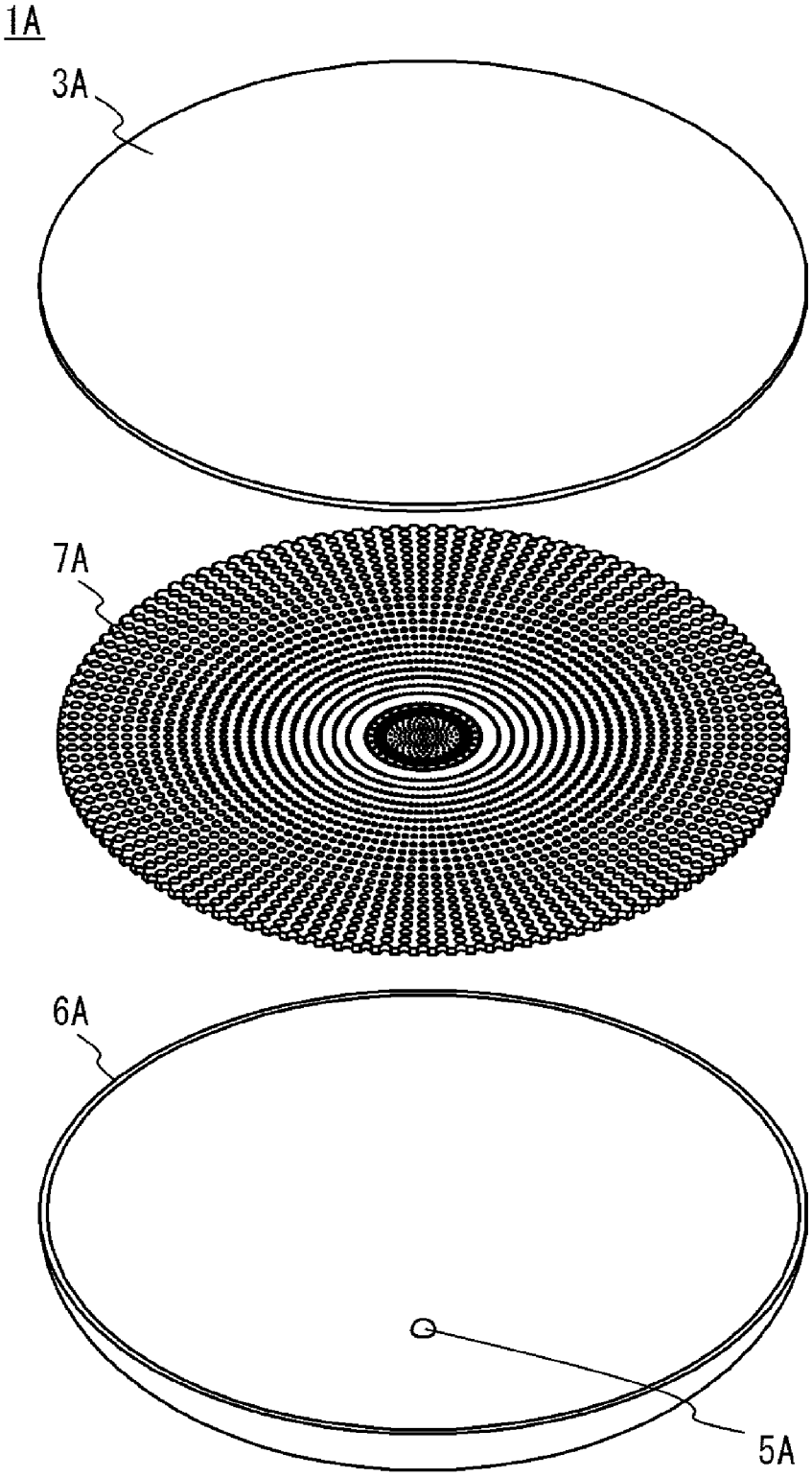
[FIG. 6]

An illumination device according to a second embodiment of the present invention will be described using FIGS. 5A, 5B, and 6. FIG. 5A is a perspective view of the illumination device according to the second embodiment of the present invention; FIG. 5B is a sectional view along VB-VB line of FIG. 5A; and FIG. 6 is an exploded perspective view of the illumination device of FIG. 5A.

In this illumination device 1A according to the second embodiment, a part of the configuration differs from that of the illumination device 1 according to the first embodiment whereas the other part thereof is in common with that of the illumination device 1. Thus, a suffix "A" will be added to the same reference numerals in the common parts, and detailed description thereof will be omitted. As illustrated in FIGS. 5A, 5B, and 6, the illumination device 1A does not include the frame body of the illumination device 1 according to the first embodiment, and includes a light source device 4A and a flat plate-like diffusion plate 3A that is mounted so as to cover the light source device 4A.

The light source device 4A includes a light source 5A, a bowl-like light source side reflective plate 6A to whose central portion the light source 5A is fixed and that has an opening, and a flat plate-like emission side reflective plate 7A that is disposed so as to close the opening of the light source side reflective plate 6A. In the present embodiment, a light source having the same configuration as that of the light source 5 of the first embodiment can be used as the light source 5A; the light source side reflective plate 6A also plays a role of the frame boy of the illumination device according to the first embodiment; and the flat plate-like diffusion plate 3A is mounted to the opening of the light source side reflective plate 6A located further outside the emission side reflective plate 7A with a gap from the emission side reflective plate 7A. As illustrated in FIG. 5B, the end of the diffusion plate 3A is rolled in to the light source device 4A side to form a fixing portion 11, and is latched to be fixed to a rolled-out open end 6*b* of the light source side reflective plate 6A. In other words, the diffusion plate 3A also has a function as fixing means that fixes the emission side reflective plate 7A to the light source side reflective plate 6A.

In the second embodiment, the emission side reflective plate 7A is a flat plane whereas the light source side reflective plate 6A is bowl-like. Therefore, the distance between the light source side reflective plate 6A and the emission side reflective plate 7A is greatest at the portion where the light source 5A is disposed, and decreases as being farther away from the light source 5A to be zero at a circumferential edge portion of the illumination device 1A. Although the light source side reflective plate 6A of the present invention has a bowl shape, the shape may be a truncated cone shape, a truncated pyramid whose base has a polygonal shape, or a part of a sphere.

The emission side reflective plate 7A has the same configuration as that of the emission side reflective plate 7 of the light source device 4 of the first embodiment, except that the emission side reflective plate 7A has a flat plane shape and includes no locking hole for being fixed to the light source side reflective plate 6A. Although the emission side reflective plate 7A is fixed to the light source side reflective plate 6A by the diffusion plate 3A in the second embodiment, the emission side reflective plate 7A may be fixed to the light source side reflective plate 6A by the same fixing means as that of the first embodiment or by other known fixing means. The same frame body as that of the first embodiment may be provided outside the light source device 4A.

In the illumination device 1A of the second embodiment, the light source side reflective plate 6A and the emission side reflective plate 7A are fixed without a gap therebetween. This can provide the illumination device 1A that gives a thinner impression at the outer edge portion thereof. Furthermore, the light source side reflective plate 6A has a bowl shape, and the emission side reflective plate have a flat plane-like shape. Therefore, when the illumination device 1A is buried in a ceiling, a wall, or the like for installation, the illumination device 1A can have a flat plane-like appearance, and the space for burying it can be thinner In addition, the omission of the frame body and the direct fixing of the diffusion plate 3A to the light source side reflective plate 6A can reduce the number of parts.

[Third Embodiment]

Figure 7:
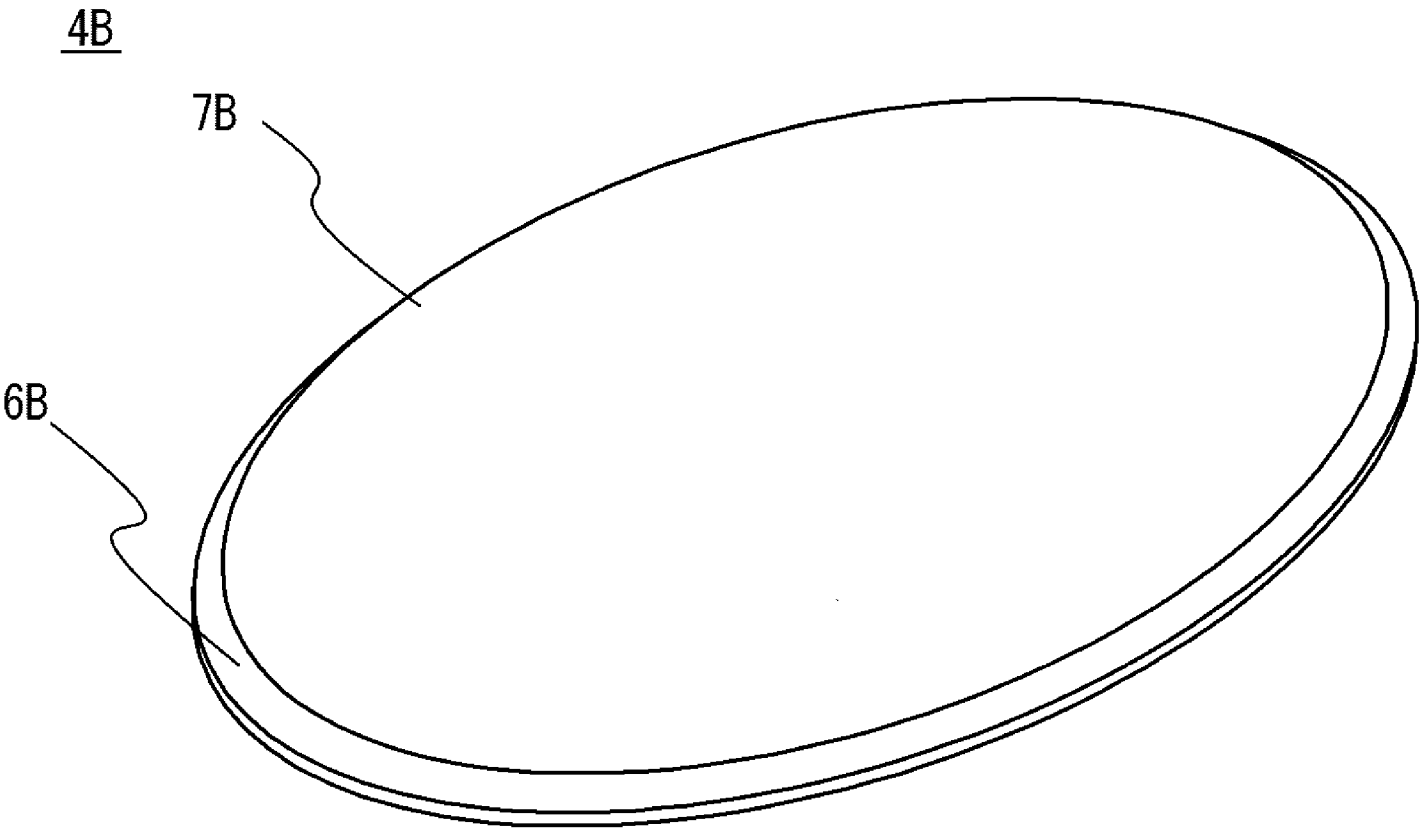
[FIG. 7]
Figure 8:
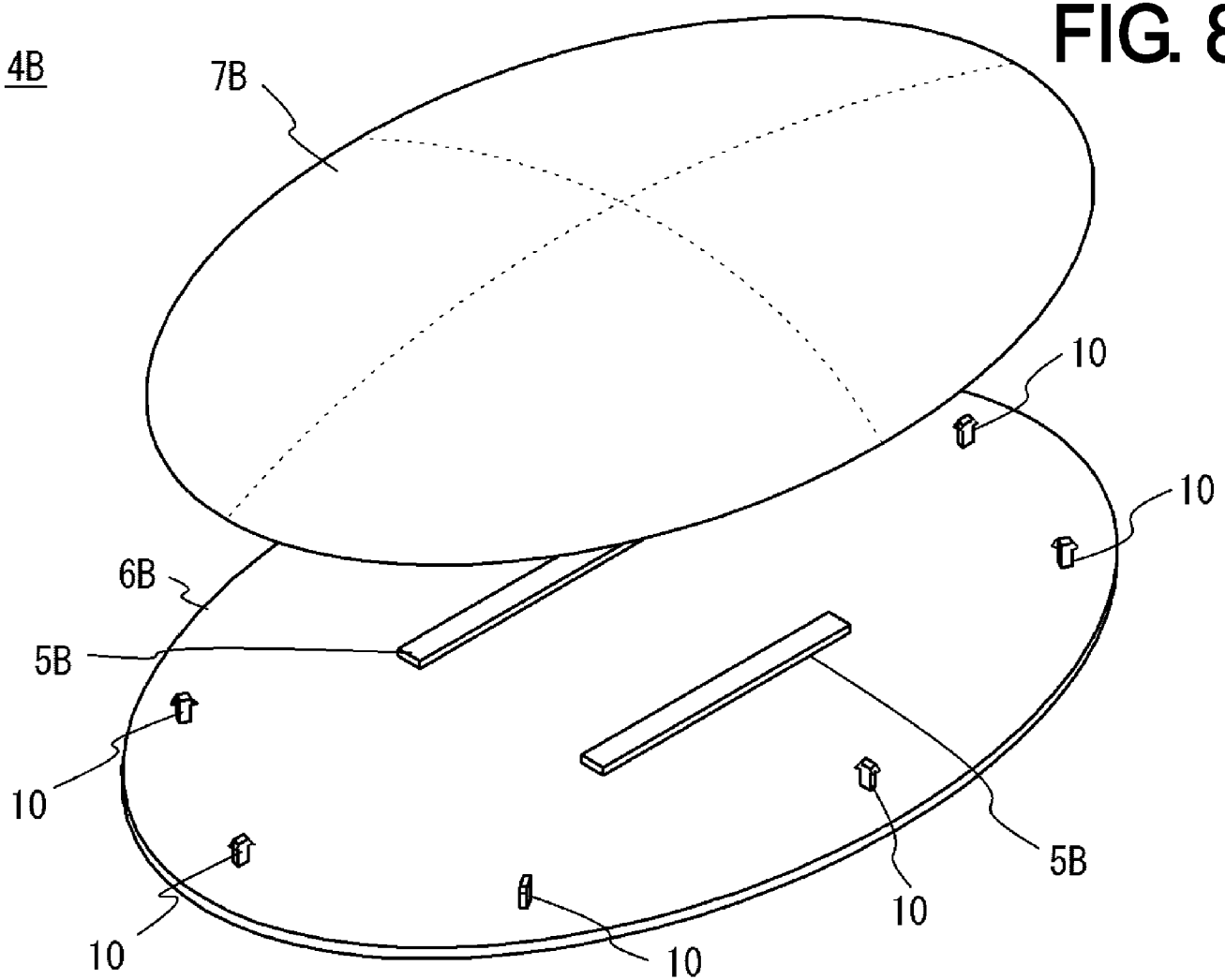
[FIG. 8]
Figure 9:
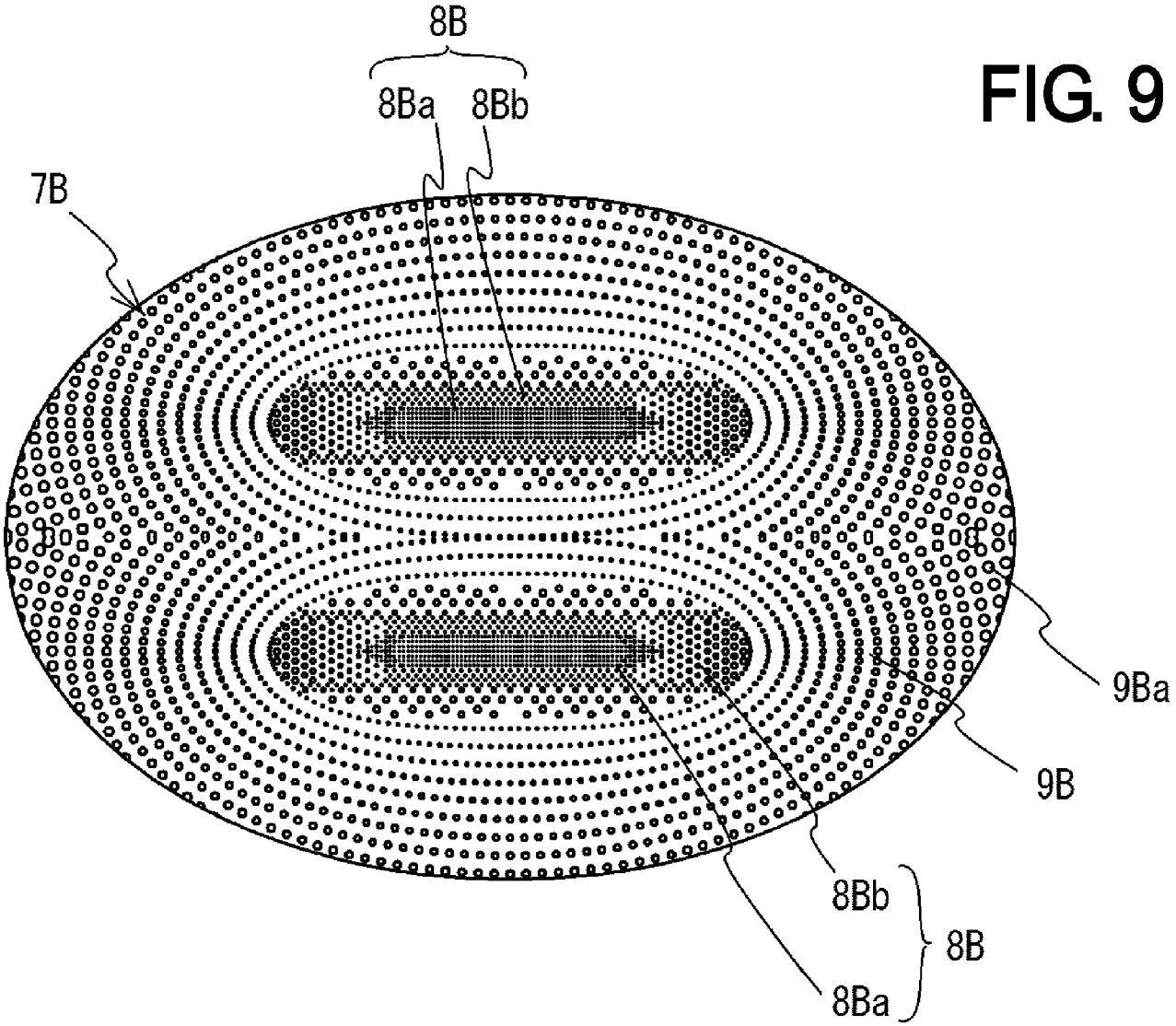
[FIG. 9]

A light source device according to a third embodiment of the present invention will be described using FIGS. 7 to 9. FIG. 7 is a perspective view of the light source device according to the third embodiment of the present invention; FIG. 8 is an exploded perspective view of the light source device of FIG. 7; and FIG. 9 is a plan view of an emission side reflective plate of the light source device of FIG. 8. In FIGS. 7 to 9, the illumination device does not include a diffusion plate or a frame body.

An illumination device 1B according to the third embodiment of the present invention differs from the illumination device 1 according to the first embodiment in the shape of the light source device 4 and the arrangement of a light source 5B whereas the other part is in common with the illumination device 1. Thus, for the common part, illustrations will be omitted, a suffix "B" will be added to the same reference numerals, and detailed description thereof will be omitted.

As illustrated in FIGS. 7 to 9, a light source device 4B of the illumination device 1B according to the third embodiment includes two light sources 5B each having a particular length, an oval flat plate-like light source side reflective plate 6B to which the light sources 5B are fixed, and an emission side reflective plate 7B that has an oval truncated cone shape and is disposed so as to face the light source side reflective plate 6B. In the third embodiment, each of the light sources 5B includes a plurality of linearly arranged LEDs.

The emission side reflective plate 7B has a truncated cone shape, like that of the first embodiment, and the base and top thereof are oval in accordance with the shape of the light source side reflective plate 6B. Two central light conducting reflection sections 8B corresponding to the two light sources 5B are provided above the light sources 5B, and an outer light conducting reflection section 9B is provided in a peripheral portion of the central light conducting reflection sections 8B. Central portions 8Ba each having a length corresponding to that of the light sources 5B are provided at central portions of the central light conducting reflection sections 8B, that is, at portions directly above the light sources 5B. Peripheral portions 8Bb are provided around the central portions 8Ba, that is, at boundary portions with the outer light conducting reflection section 9B. The distance between the light source side reflective plate 6B and the emission side reflective plate 7B is greatest at the central light conducting reflection sections 8B, and decreases as being farther away from the light source to become smallest at the circumferential edge portion of the illumination device, and a gap is provided between ends of the light source side reflective plate 6B and the emission side reflective plate 7B. A portion sandwiched by the two central light conducting reflection sections 8B has little effect on the apparent thickness of the illumination device. Therefore, the distance between the light source side reflective plate 6B and the emission side reflective plate 7B is the same as the distance to the light source side reflective plate 6B at the central light conducting reflection sections 8B.

Conducting holes 9Ba provided in the outer light conducting reflection section 9B are arranged in an opening pattern in which areas of the conducting holes 9Ba become gradually larger as being farther away outward from the two central light conducting reflection sections 8B.

Although the LEDs are linearly arranged in the illumination device 1B according to the third embodiment, the arrangement is not limited to a linear manner, and the LEDs can be arranged in various shapes, such as ring-like and rectangular shapes. In this case, the area, optical reflectance, and optical transmittance of the central light conducting reflection sections are adjusted according to the arrangement.

Figure 10:
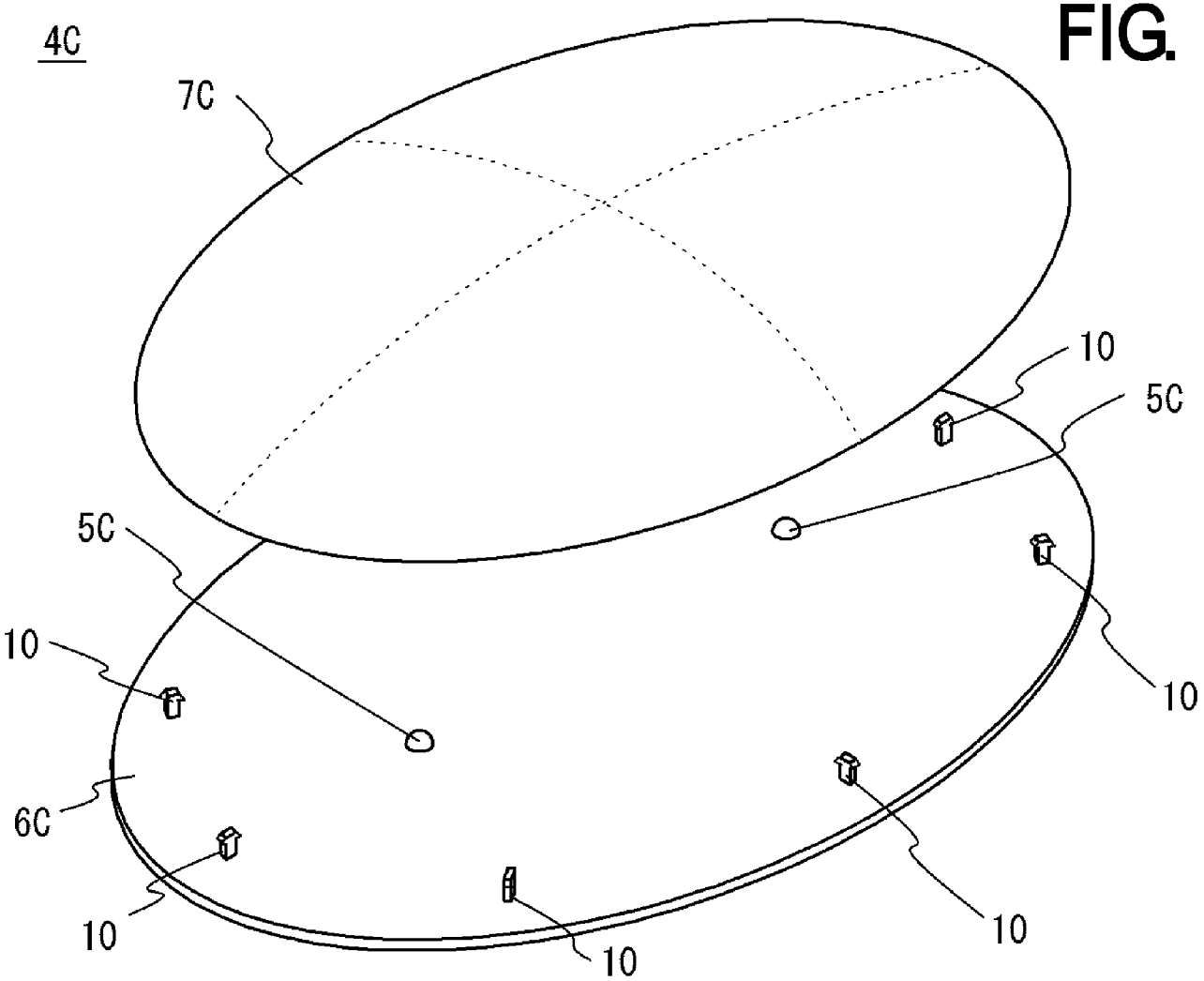
[FIG. 10]
Figure 11:
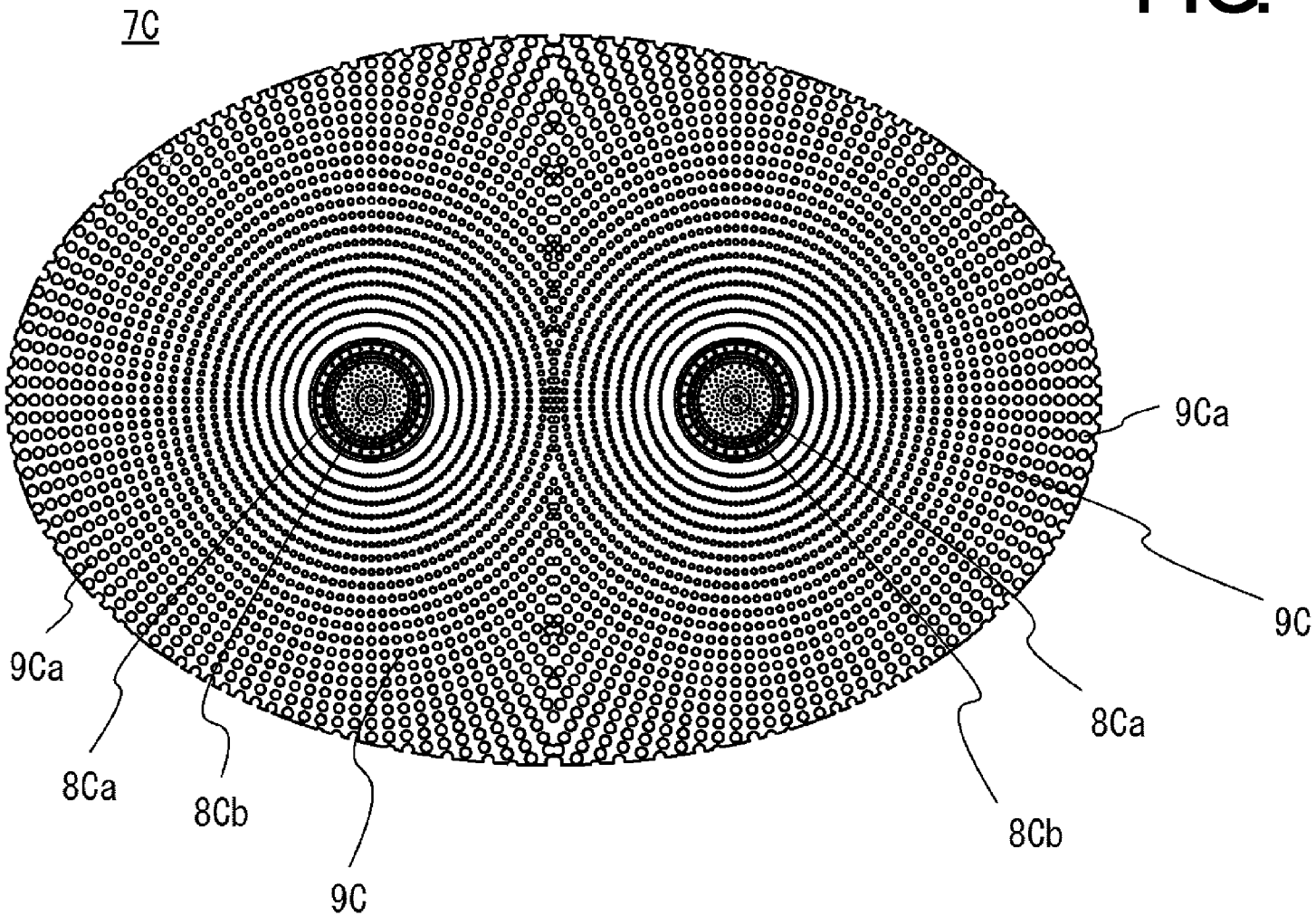
[FIG. 11]
Figure 12:
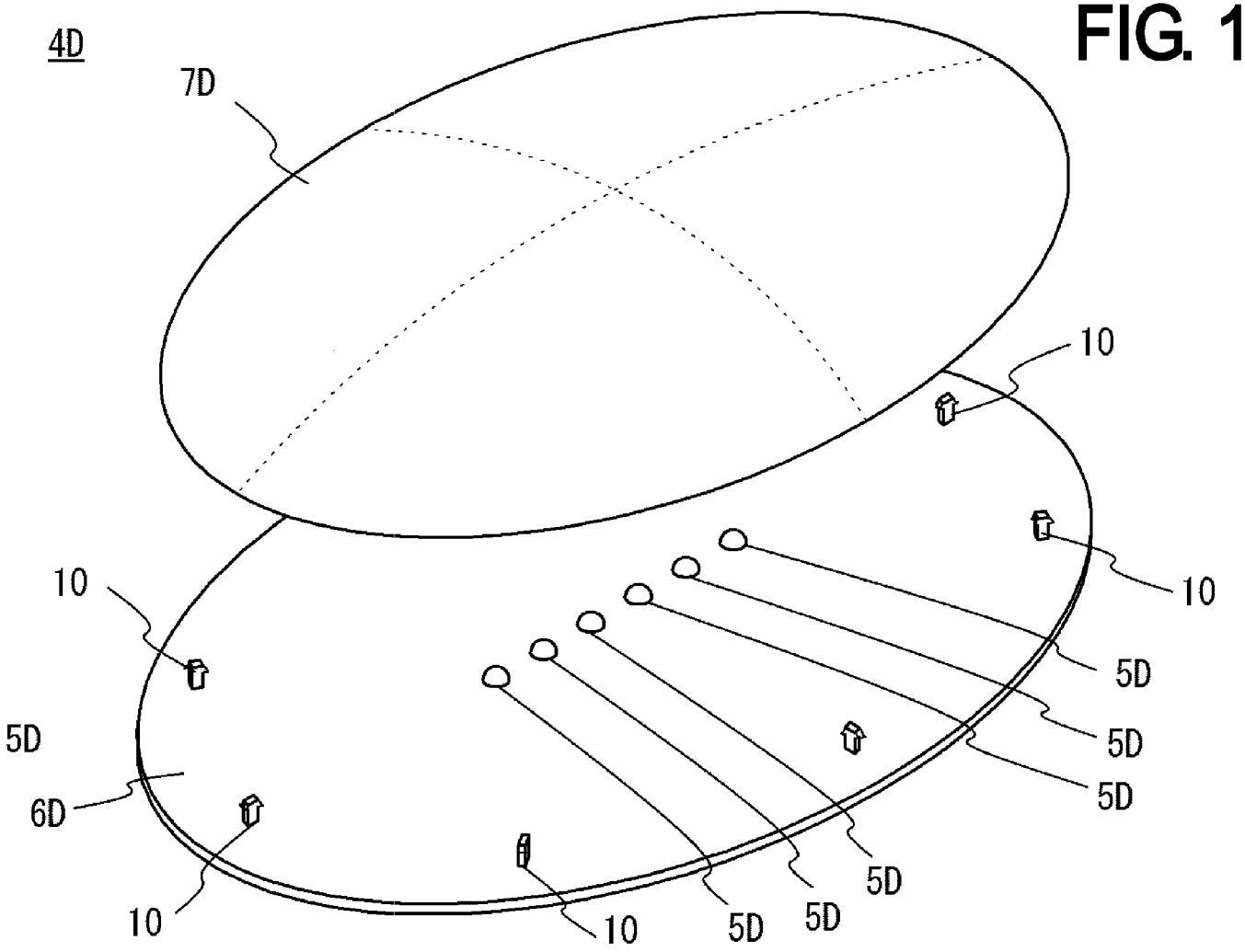
[FIG. 12]
Figure 13:
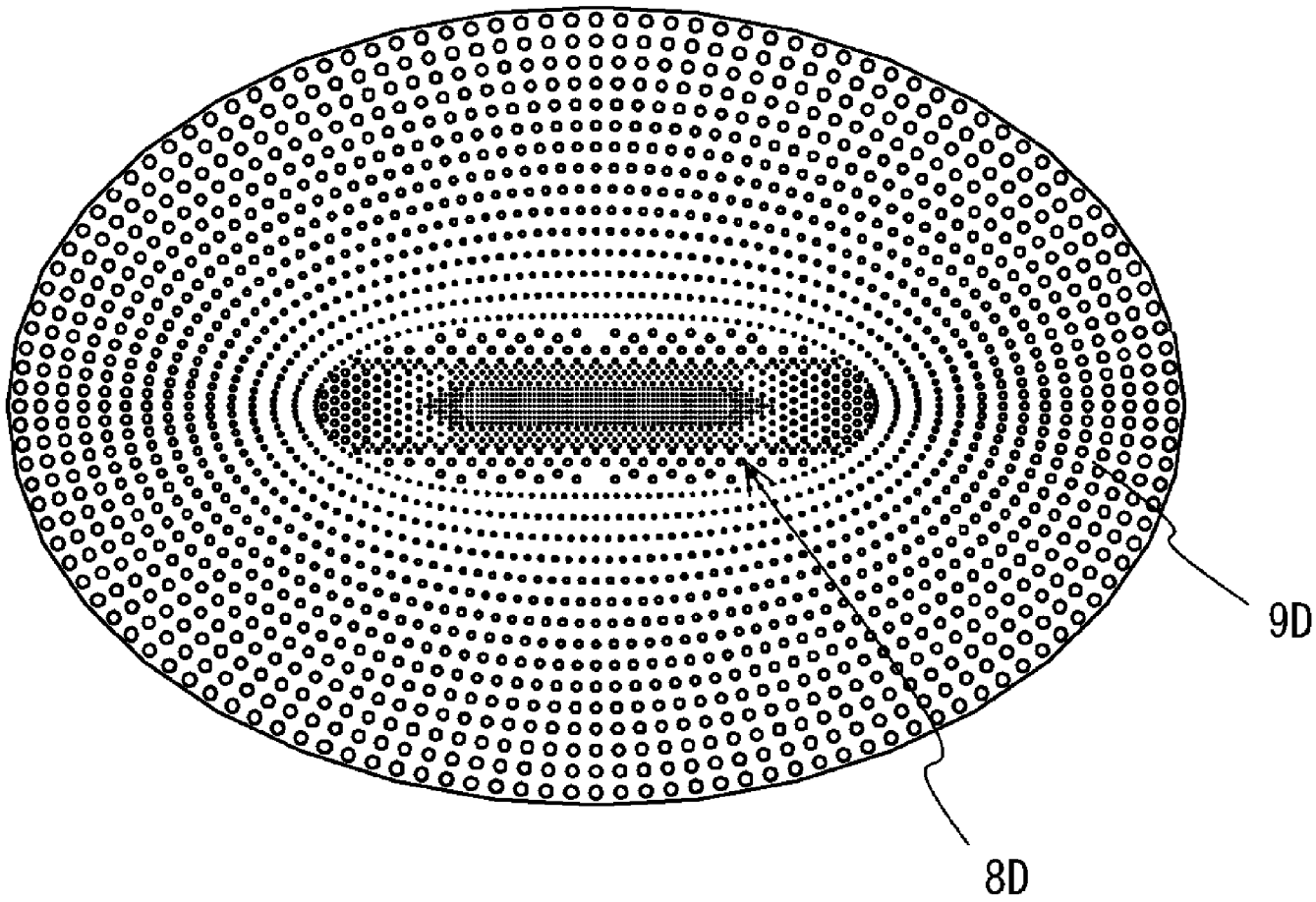
[FIG. 13]

Modifications of the light source device 4B according to the third embodiment of the present invention will be described using FIGS. 10 to 13. FIG. 10 is an exploded perspective view of a modification of the light source device according to the third embodiment of the present invention; FIG. 11 is a plan view of an emission side reflective plate of the light source device of FIG. 10; FIG. 12 is an exploded perspective view of another modification of the light source device according to the third embodiment of the present invention; and FIG. 13 is a plan view of an emission side reflective plate of the light source device of FIG. 12.

In a light source device 4C of a first modification according to the third embodiment, light sources 5C are disposed at two places of an oval light source side reflective plate 6C at a particular interval (refer to FIG. 10). In this case, central light conducting reflection sections 8C are provided at respective portions directly above the two light sources 5C, and an outer light conducting reflection section 9C is provided around the outer circumferences of the central light conducting reflection sections 8C each having a central portion 8Ca and a peripheral portion 8Cb. Specifically, an opening pattern of conducting holes 9Ca is arranged, the pattern in which the conducting holes 9Ca become gradually larger as being farther away outward from the two central portions 8Ca (refer to FIG. 11).

In a light source device 4D of a second modification according to the third embodiment, six light sources 5D linearly arranged at particular intervals are disposed at a central portion of the long axis of an oval light source side reflective plate 6D (refer to FIG. 12). In this case, the distances between the light sources 5D are small, so that the light sources 5D can be assumed as a linear light source. A central light conducting reflection section 8D having a length corresponding to the virtual linear light source is provided at a portion directly above the light sources 5D, and an outer light conducting reflection section 9D is provided in the outer circumference of the central light conducting reflection section 8D (refer to FIG. 13).

As exemplified in the modifications above, an illumination device that is brighter while having a large size can be obtained by arranging a plurality of LEDs, which are known point sources of light, having a large luminescence intensity or by using LEDs arranged in a strip-like or ring-like manner Brighter and uniform illumination light can be obtained by adjusting the area, optical reflectance, and optical transmittance of the central light conducting reflection sections according to the arrangement.

EXPLANATIONS OF LETTERS OR NUMERALS

1, 1A, 1B, 1C, 1D illumination device
2, 2A frame body
3, 3A diffusion plate

4, 4A, 4B, 4C, 4D light source device
5, 5A, 5B, 5C, 5D light source
6, 6A, 6B, 6C, 6D light source side reflective plate
6*a* mounting hole
6*b* end of opening
7, 7A, 7B, 7C, 7D emission side reflective plate
7*a* locking hole
8, 8C, 8D central light conductive reflective portion
8*a* central portion
8*b* peripheral portion
9, 9C, 9D outer light conductive reflective portion
9*a* conducting hole
10 fixing member
11 fixing portion

The invention claimed is:

1. A light source device comprising:
a light source;
a light source side reflective plate to which the light source is fixed;
an emission side reflective plate facing the light source side reflective plate; and
fixing means for fixing the light source side reflective plate and the emission side reflective plate,
the light source being constituted by one or a plurality of light-emitting diodes,
the emission side reflective plate being formed so that a portion thereof facing the light source has the highest optical reflectance and the lowest optical transmittance while the optical reflectance decreases and the optical transmittance increases as being farther away from the light source, and
the distance between the light source side reflective plate and the emission side reflective plate being greatest at a portion where the light source is disposed and decreases as being farther away from the portion where the light source is disposed.

2. The light source device according to claim 1, wherein the fixing means is a columnar body that is provided at outer edge portions of the light source side reflective plate and the emission side reflective plate and has a particular height; and the fixing means fixes the light source side reflective plate and the emission side reflective plate with a gap therebetween.

3. The light source device according to claim 1, wherein the fixing means is a member that fixes the light source side reflective plate and the emission side reflective plate without a gap therebetween at the outer edge portions of the light source side reflective plate and the emission side reflective plate.

4. The light source device according to claim 1, wherein an optical diffusion plate is provided on the light emitting surface side of the emission side reflective plate with a particular gap from the emission side reflective plate.

5. The light source device according to claim 1, wherein the light source includes the light-emitting diodes arranged in a strip-like or ring-like manner.

6. An illumination device comprising:
a light source device; and
a diffusion plate covering the light source device,
the light source device including:
a light source;
a light source side reflective plate to which the light source is fixed;
an emission side reflective plate facing the light source side reflective plate; and
fixing means for fixing the light source side reflective plate and the emission side reflective plate,
the light source being constituted by one or a plurality of light-emitting diodes,
the emission side reflective plate being formed so that a portion thereof facing the light source has the highest optical reflectance and the lowest optical transmittance while the optical reflectance decreases and the optical transmittance increases as being farther away from the light source, and
the distance between the light source side reflective plate and the emission side reflective plate being greatest at a portion where the light source is disposed and decreases as being farther away from the portion where the light source is disposed.

7. The illumination device according to claim 6, wherein the illumination device further includes a frame body to which the light source device is fixed.

* * * * *